US008647462B2

(12) United States Patent
Su et al.

(10) Patent No.: US 8,647,462 B2
(45) Date of Patent: Feb. 11, 2014

(54) FLEXIBLE IMPLEMENT HANDLE GRIP AND METHOD OF MAKING SAME

(71) Applicant: Eaton Corporation, Cleveland, OH (US)

(72) Inventors: Wen-Chen Su, Pinehurst, NC (US); David Keith Gill, Pinehurst, NC (US); Billy Dee Wood, Whispering Pines, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/625,064

(22) Filed: Sep. 24, 2012

(65) Prior Publication Data

US 2013/0017900 A1 Jan. 17, 2013

Related U.S. Application Data

(62) Division of application No. 13/151,561, filed on Jun. 2, 2011, now abandoned.

(51) Int. Cl.
*B32B 37/00* (2006.01)
*B29C 65/00* (2006.01)

(52) U.S. Cl.
USPC ..... 156/245; 156/277; 156/306.9; 473/300; 473/549

(58) Field of Classification Search
USPC ..... 156/185, 186, 194, 212, 213, 245, 277, 156/306.6, 306.9, 338, 187, 188, 293, 294; 473/298, 299, 300, 303, 201, 549, 301, 473/302, 551
See application file for complete search history.

(56) References Cited

U.S. PATENT DOCUMENTS

| | | | | | |
|---|---|---|---|---|---|
| 1,890,037 | A | * | 12/1932 | Johnson | 473/300 |
| 1,958,479 | A | * | 5/1934 | Hazell et al. | 524/11 |
| 2,562,139 | A | * | 7/1951 | Campbell | 524/380 |
| 3,979,547 | A | * | 9/1976 | Roberts et al. | 152/525 |
| 4,037,038 | A | * | 7/1977 | Tsuchiya | 525/386 |
| 2005/0209016 | A1 | * | 9/2005 | Huang | 473/300 |
| 2006/0178226 | A1 | * | 8/2006 | Hung | 473/301 |
| 2007/0287551 | A1 | * | 12/2007 | Wang et al. | 473/300 |
| 2008/0176670 | A1 | * | 7/2008 | Gill et al. | 473/300 |

FOREIGN PATENT DOCUMENTS

| | | | | |
|---|---|---|---|---|
| JP | 63224914 | A | * | 9/1988 |
| JP | 2008049596 | A | * | 3/2008 |

OTHER PUBLICATIONS

Machine translation of JP 63224914 date unknown.*
Machine translation of JP 2008-049596 date unknown.*

* cited by examiner

*Primary Examiner* — John Goff
(74) *Attorney, Agent, or Firm* — Fay Sharpe LLP

(57) ABSTRACT

A flexible implement grip is formed with an underlist of one rubber compound wrapped with a skin of a second rubber compound with multi-colored rubber based paint or ink air dried thereon and the assembled grip vulcanized in a mold. In one version, the skin pattern is cut from a sheet of cured rubber and curable adhesive employed with the wrapping. In another version, the multi-colored ink or paint is air dried on an uncured sheet prior to cutting the skin pattern; and, no adhesive is employed with the wrapping and bonding to the underlist occurs during final vulcanizing.

6 Claims, 5 Drawing Sheets

FLEXIBLE IMPLEMENT HANDLE GRIP AND METHOD OF MAKING SAME

This Divisional application claims the priority benefit of U.S. application Ser. No. 13/151,561, filed Jun. 2, 2011, now abandoned, the disclosure of which is incorporated herein by reference.

The present disclosure relates to flexible grips for an implement handle and particularly golf club grips where it is desired to have a high degree of softness or flexibility to the grip in order to enhance the gripability and comfort to the user. It has further been desired to provide colorful graphic designs on the grip to enhance the appearance and to provide for manufacturers identification and to provide different product differentiation for enhancing marketability.

Heretofore, in order to provide the colorful designs and marking on a flexible golf club grip, it has been necessary to use polymeric materials in the grip in order to accept the ink or paint employed to provide the desired design or markings. Current practice for golf club grips has been to employ polyurethane material over an underlist of polymer material such as ethylene vinyl acetate (EVA), which material has usage resulted in a golf club grip with undesirable flexibility characteristics.

Where the golf club has employed natural rubber, synthetic rubbers such as styrene butadiene rubber (SBR) or ethylene propylene diene monomer rubber (EPDM). Heretofore, it has been found difficult to apply and maintain colorful graphic designs on a golf club grip inasmuch as the painted colors were easily abraded in usage resulting in an undesirable appearance and loss of the graphic design. Thus, it has been desired to provide a way or means of making an implement grip such as a golf club grip which provided the softness and gripability of rubber with a decorative design having abrasion resistance and durability of the color design yet retaining the surface texture and gripability of rubber.

SUMMARY

The present disclosure describes a method of making a rubber implement grip such as a golf club grip in which a cured underlist is formed of natural rubber, synthetic rubber, or blended rubber and a relatively soft flexible skin with a multicolored design thereon wrapped about the underlist with or without a vulcanizable rubber adhesive therebetween and the completed grip is vulcanized. In one version, the underlist is formed of one rubber compound; and, the skin is formed of a second rubber compound with the colored design on the skin formed of ink and paint selections which may include rubber, acrylic, urethane, etc. applied thereto and warm air dried thereon. The unvulcanized painted skin is then wrapped on the cured underlist without adhesive therebetween and the entire assembled grip is vulcanized and debossed to form a multi-colored 3D texture cured grip. In another version, the cured underlist is formed of a first rubber compound and the skin is formed of a relatively thin sheet of a second rubber compound which is vulcanized and debossed to form a desired 3D texture, then a thermally curable rubber based ink or thermally curable rubber based paint is applied thereto and warm air dried thereon. The skin is then cut to a pattern and the pattern wrapped on the underlist with vulcanizable rubber adhesive therebetween; and, the completely assembled grip is then vulcanized.

DETAILED DESCRIPTION

Figure 1:
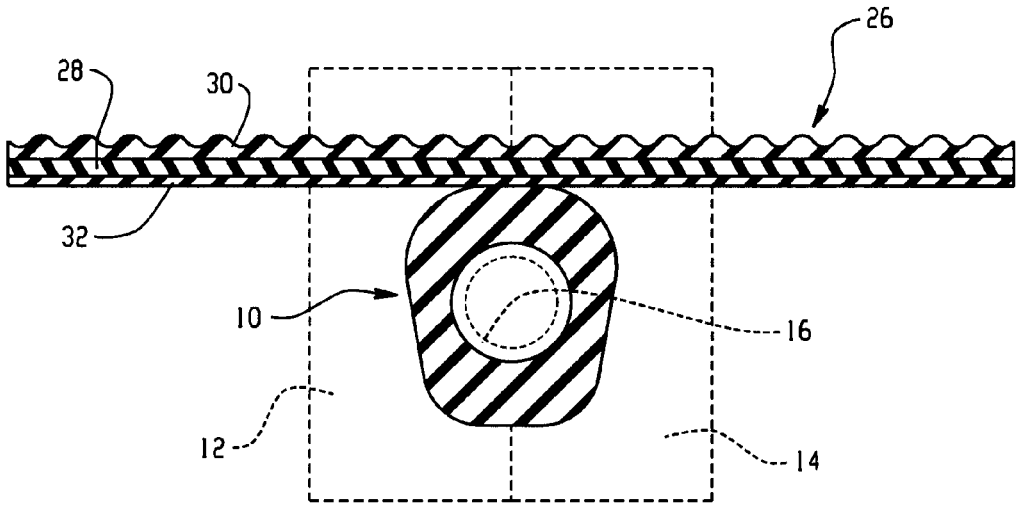
FIG. 1 is a cross-section of one version of a flexible rubber implement grip prior to assembly of the cured skin over the underlist.

Referring to FIG. 1, an underlist of the implement or golf club grip is illustrated generally at 10 and is formed and vulcanized in a mold comprising two halves 12, 14, illustrated in dashed outline with an internal mandrel 16 also shown in dashed outline, and which components 12, 14 and 16 are removed after vulcanizing to form the underlist 10. In the present practice, it has been found satisfactory to compound the underlist 10 of one of a natural rubber compound, a synthetic rubber compound or a blend of natural rubber and synthetic rubber. In the present practice, the molding process may be by injection, compression or transfer molding. If either injection or transfer molding is to be utilized, in the present practice it has been found satisfactory to run the strip stock in the range of about 40 to 80 mm wide and in the range of about 10 to 20 mm thick. If compression molding is to be employed, it has in the present practice been found satisfactory to calender the stock in the range of about 2-5 mm thick. The stock is then loaded into the mold comprising mandrel 16 and mold halves 12, 14 and the stock is vulcanized. In the present practice, it has been found satisfactory to pressure vulcanize the rubber underlist compound at a pressure in the range of about 2000-3000 psi (13,800 Kpa to 24,000 Kpa) and at a temperature in the range of about 130° C. to 185° C. and for a time in the range of about 90 to 500 seconds with the curing time chosen according to the size of the molded part.

Figure 5:
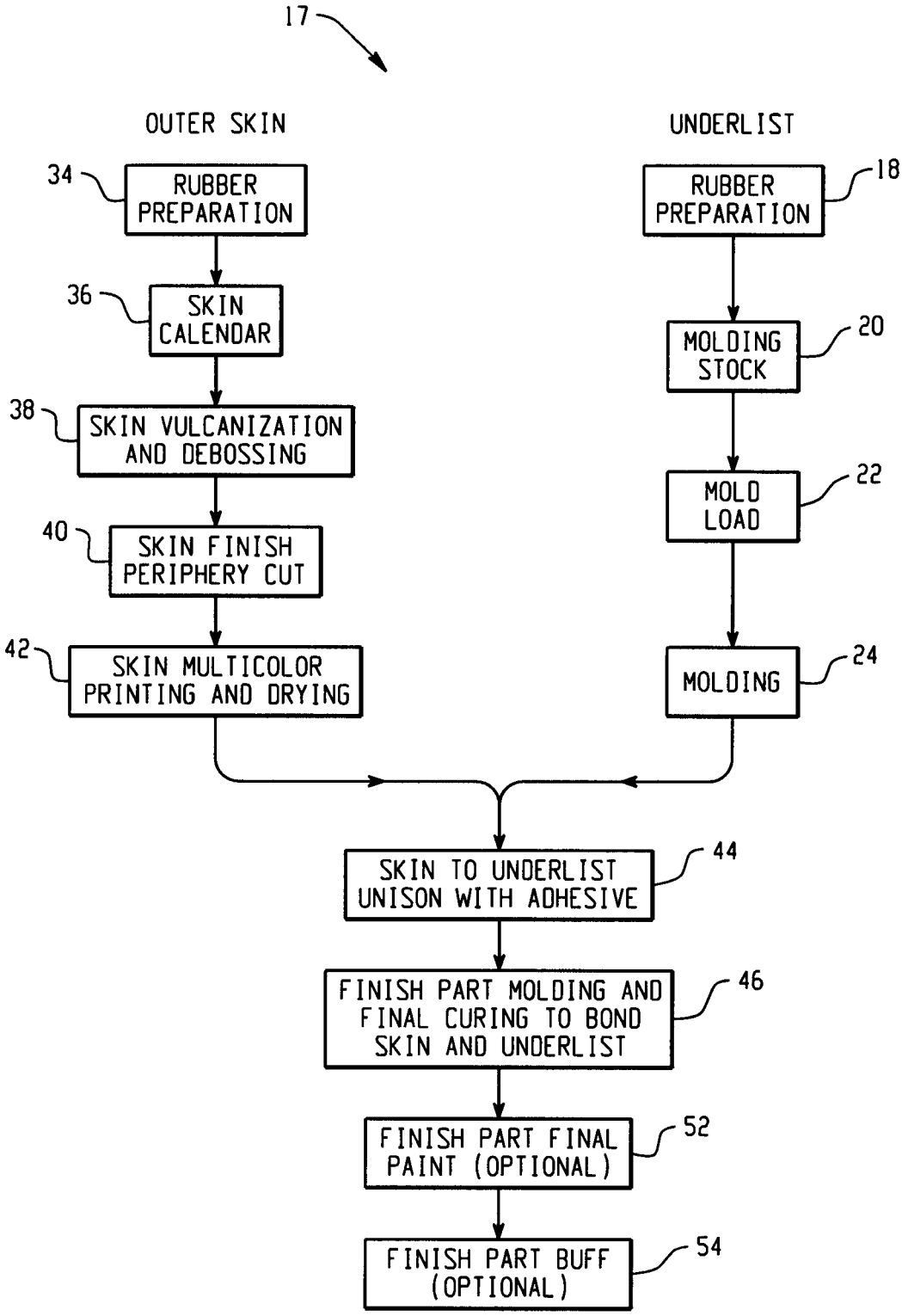
FIG. 5 is a block diagram of one version of the method of the present disclosure.

With reference to FIG. 5, indicated is the first version of the method at 17, illustrated in block diagram, wherein the underlist 10 is fabricated by the rubber preparation or compounding at step 18, calendered to the desired thickness at step 20, loaded into the mold at step 22 and vulcanized at step 24 and removed from the mold.

Referring to FIG. 1, a wrap indicated generally at 26 comprises a vulcanized skin layer 28 surrounded on its exterior surface by a painted or inked multi-colored design 30 which may be embossed to form a 3D texture, as will hereinafter be described. The opposite or undersurface of the wrap 26 has disposed thereon a layer of uncured rubber adhesive 32.

Figure 2:
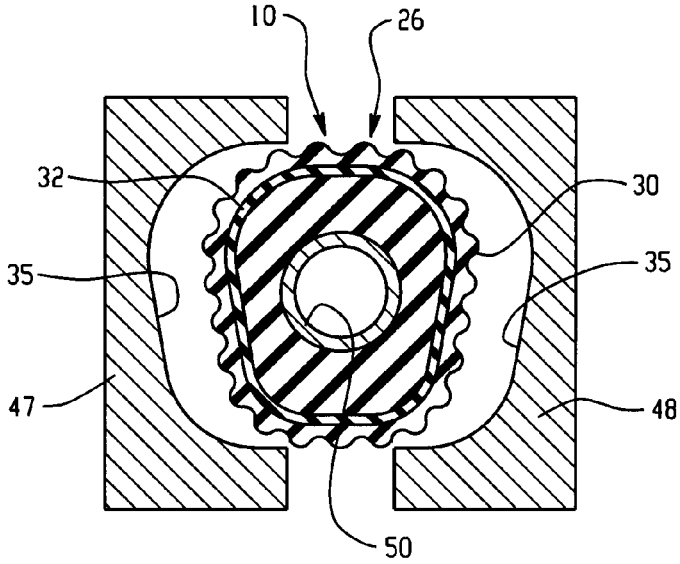
FIG. 2 is a cross-sectional view of the assembled grip of FIG. 1 prior to vulcanizing.

With reference to FIG. 2, the wrap 26 is shown disposed completely about the exterior surface of the underlist 10 in preparation for final molding in mold halves 47, 48. Because the surface 30 of wrap 26 has been already textured, the interior surface 35 of the mold halves 47, 48 are smooth.

In the present practice, the second rubber compound employed for skin layer 28 may be a blend of natural and synthetic rubber which is formulated to provide a desired finished 3D texture and feel and appearance upon molding as well as durability. If desired, the second compound employed for the skin may be of the same rubber compound as employed for the underlist. However, generally, the compound chosen for the skin 28 is compounded to have a softer feel and thus a relative lower durometer than the compound employed for the underlist. The rubber compound formulated for the wrap is calendered to a sheet of desired thickness; and, in the present practice, it has been found satisfactory to calender the skin sheet to a thickness in the range of about 0.1 mm to 3.0 mm with the thickness chosen to accommodate the size of the grip.

Referring to FIG. 5, the process of the first version of the method is illustrated wherein the rubber is compounded at step 34 and calendered to the desired thickness at step 36. The calendered skin stock is then vulcanized and debossed or textured on its surface at step 38 as for example in a platen press (not shown). In the present practice, it has been found satisfactory to vulcanize the skin at a pressure in the range of about 13,000 Kpa to about 24,000 Kpa and at a temperature in the range of about 130° C. to 185° C. for a time in the range of about 90 to 500 seconds, with the time chosen in accordance with the size of the part to be molded.

The vulcanized skin is then removed from the platen press (not shown) and is cut to a desired pattern size at step 40. In the present practice it has been found satisfactory to use a template (not shown) to correctly size the pattern for wrapping about the underlist. In accordance with the first version of the method of the present disclosure, the vulcanized and textured rubber skin 28, after removal from the unshown platen press, is printed with a multi-colored design as desired for the appearance of the finished grip as denoted by reference numeral 42 in FIG. 5. In the present practice, the design printed upon the vulcanized skin 28 is accomplished with one of a thermally curable rubber based ink or thermally curable rubber based paint such as, for example, styrene butadiene rubber, natural rubber, synthetic rubber or ethylene propylene diene monomer (EPDM) rubber. The ink or paint as the case may be is then warm air dried. In the present practice, it has been found satisfactory to employ air at a temperature in the range of about 100° C. to 125° C. for a time in the range of about 30 to 330 second. In the present practice, it has been found satisfactory to maintain the volume of air flow of the drying air at a rate less than 5 cubic feet per minute through a wide orifice nozzle to avoid rippling of the printed surface.

Referring to FIGS. 1, 2 and 5, the wrap 26 is then prepared for molding by application of uncured rubber adhesive 32 to the undersurface of the skin 28; or, alternatively, the uncured rubber adhesive may be applied about the outer surface of the underlist 10. The wrap is then positioned about the underlist 10 at step 44 in FIG. 5 and as shown in FIG. 2.

The wrapped underlist shown in FIG. 2 is inserted in a mold comprising mold halves 47, 48 and interior mandrel 50; and, the finished part is vulcanized at step 46 of FIG. 5 in the mold. The mold halves 47, 48 and mandrel 50 are removed after vulcanizing and the completed grip is formed with strong bonding between the printed skin and underlist. If desired, the outer surface may be painted with additional unvulcanized rubber based paint or rubber based ink at step 42. In addition, if desired, an optional finish buffing may be performed as indicated at step 54.

Figure 3:
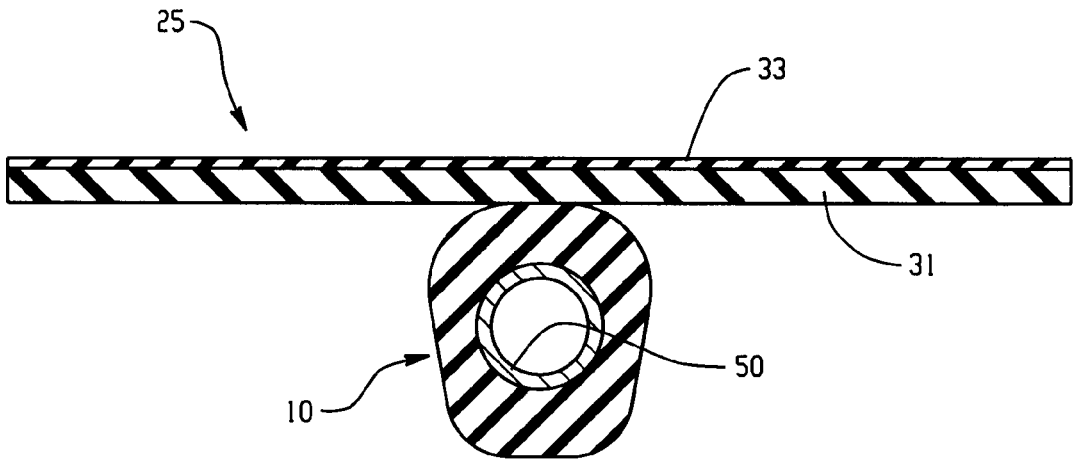
FIG. 3 is a portion of a cross-sectional view of another version of a flexible grip prior to assembly of un cured skin over the underlist.
Figure 4:
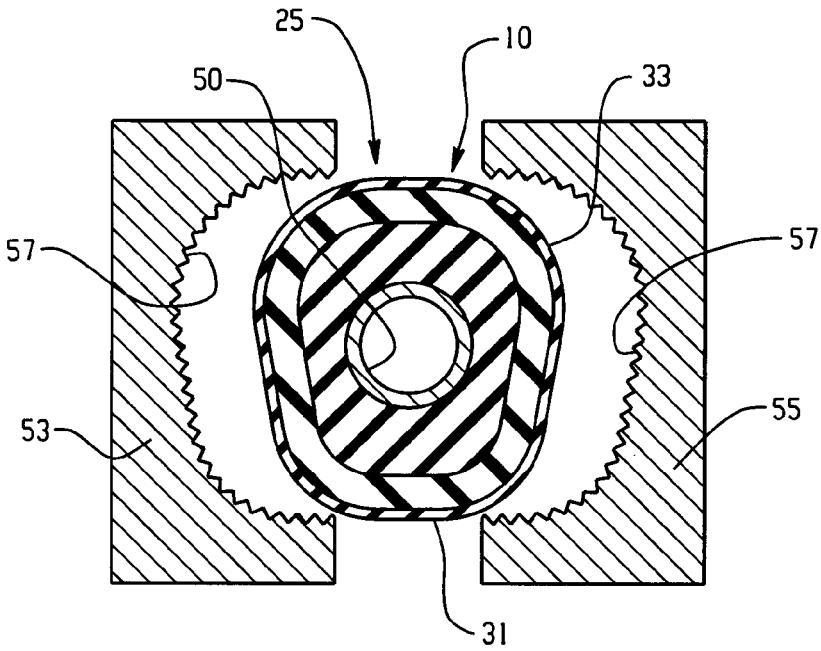
FIG. 4 is a cross-sectional view of the grip of FIG. 3 prior to vulcanizing.

Referring to FIG. 3, another version of the wrap indicated generally at 25 employs a skin 31 of uncured rubber disposed for wrapping about the underlist 10. The skin 31 has a multi-colored design 33 printed on the exterior surface thereof and is warm air dried as hereinabove described with respect to the version of FIGS. 1 and 2. The wrap 25 is then positioned about the underlist 10 as shown in FIG. 4. However, the arrangement of FIG. 4 is accomplished without any adhesive between the underlist and the skin 31. The assembled grip of the underlist 10 with wrap 25 is then positioned in the mold halves 53, 55 as shown in FIG. 4. In the arrangement of FIG. 4, the interior surfaces of the mold are provided with the texture for the surface of the grip as denoted by reference numeral 57. The mold halves 53, 55 are then closed and the grip assembly is vulcanized which may be in the manner described hereinabove with respect to FIGS. 1 and 2. In the arrangement of FIG. 4, the vulcanization causes final curing of the skin 31 and thus provides a complete bonding of the skin to the underlist without the requirement for an intermediate adhesive.

Figure 6:
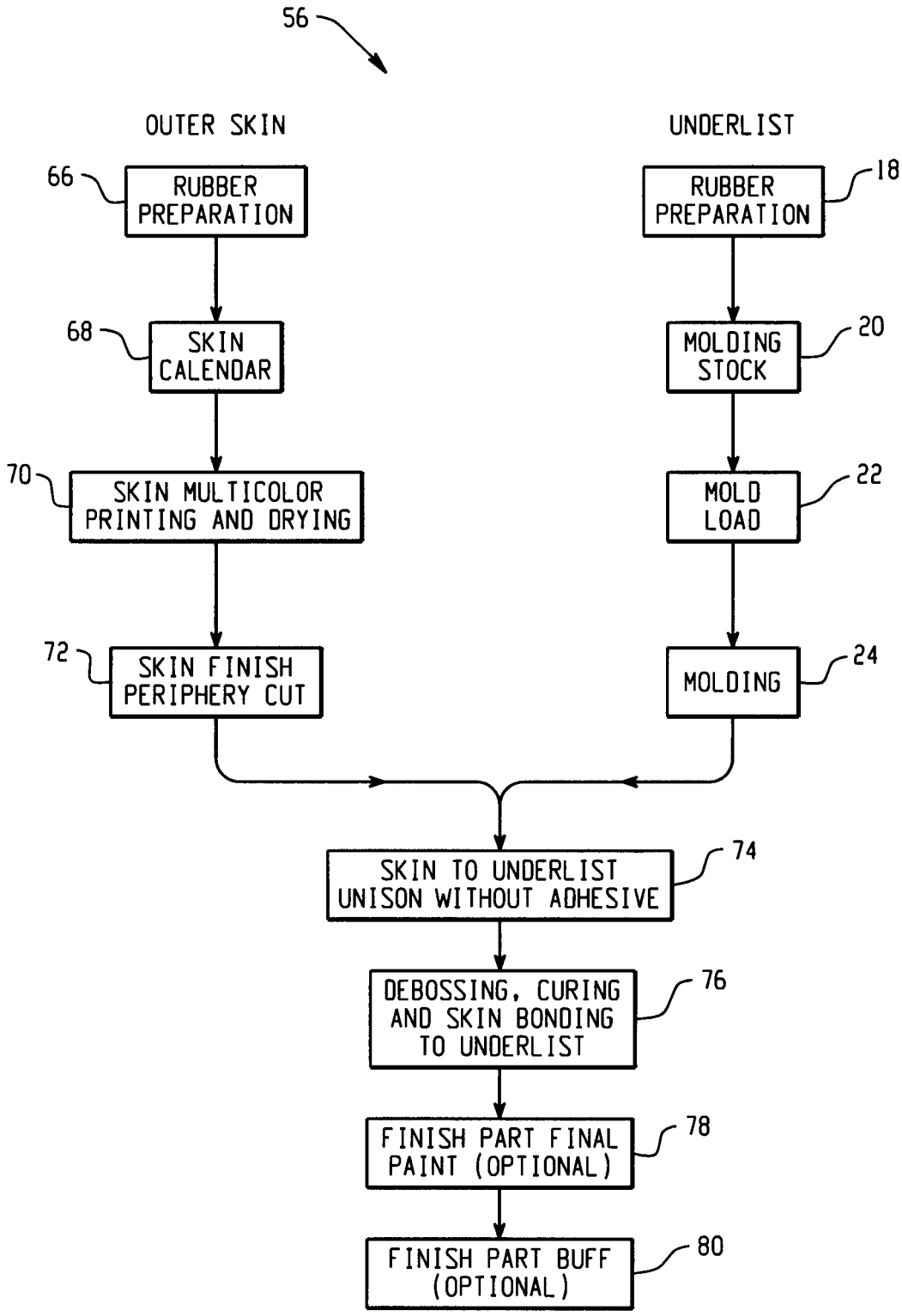
FIG. 6 is a block diagram of a second version of the method of the present disclosure.

Referring to FIG. 6, another or second version of the method indicated generally at 56 of the present disclosure is indicated generally at 56 in which the rubber compound employed for the underlist 10 is compounded at step 18 and calendered to the appropriate size at step 20 as described hereinabove with respect to the method 17. The calendered stock is then loaded into the mold comprising halves 53, 55 and mandrel 16 at step 22 and is vulcanized in the mold at step 24 and the vulcanized underlist 10 is removed from the mold.

Figure 7:
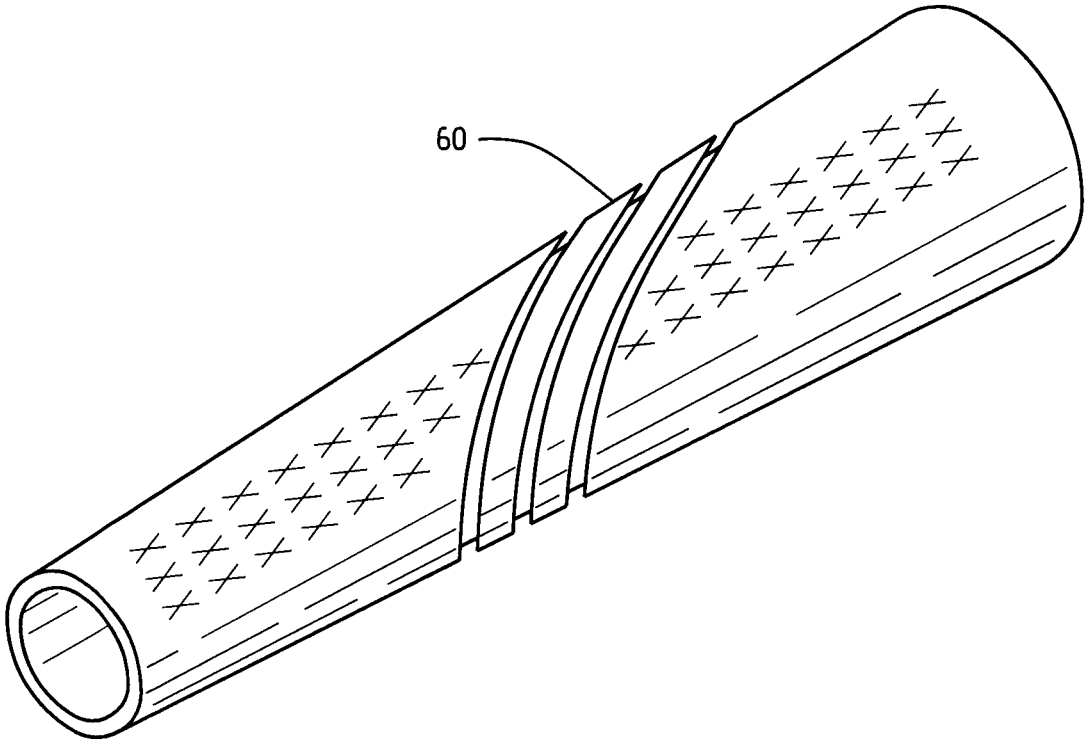
FIG. 7 is a perspective view of the vulcanized grip upon removal from the mold.

Referring to FIGS. 3, 4 and 6, concurrently with the preparation of the underlist 10, the skin 31 may be formed by preparing a second rubber compound at step 66 as described above with respect to the first version of the method. At step 68 a sheet of skin is calendered from the second compound. However, in the second version 56 of the method, the ink or paint of polymer binder selections, such as, for example, rubber, acrylic, and urethane, is applied to the unvulcanized skin 31 at step 70; and, the paint or ink is warm air dried in the manner described above with respect to the version 17 of the method. The desired pattern is then cut from the uncured skin at step 72, which may be accomplished using a template. The uncured skin with the multi-colored design without any adhesive thereon is wrapped about the underlist at step 74 in FIG. 6 to form the condition shown in FIG. 4. In the second method 56, the wrapped underlist of FIG. 4 is then inserted in the mold halves 53, 55 with mandrel 50 inserted therein and is vulcanized, debossed with 3D texture and strong bonding formed between the underlist and skin in one step by molding at step 76, which may be in accordance with the vulcanization described above with reference to the first version of method 17. The vulcanized finished grip is then removed from the mold halves 53, 55 and mandrel 50 is removed. If desired, the finished part may have additional paint applied thereto as denoted by step 78 in FIG. 6. Furthermore, if desired, the finished and painted grip may be buffed as denoted at step 80 in FIG. 6. The completed grip is illustrated at 60 in FIG. 7.

The method of the present disclosure thus provides an implement grip, particularly a golf club grip, having a rubber underlist with a soft vulcanized skin or wrap with integrally vulcanized multi-colored designs provided thereon to give the desired soft texture and feel and yet provide abrasion resistance and durability of the multi-colored design. In one version of the method, the thermally curable rubber based paint or rubber based ink is applied to a cured sheet of skin cut into a pattern and assembled over the underlist with rubber adhesive and the entire assembly vulcanized in a mold. In another version of the method of the present disclosure, any polymer binder including curable and uncurable rubber, acrylic, urethane, ink or paint is applied to an uncured calendered sheet of relatively thin stock for the skin and warm air dried thereon. The stock is then cut to a pattern and positioned on the underlist and the assembled grip with multi-colored design without additional adhesive on the skin is vulcanized and debossed or textured in a mold to form the desired skin texture and secure the skin on the underlist.

Obviously, modifications and alterations will occur to others upon reading and understanding the preceding detailed description. It is intended that the described versions be construed as including all such modifications and alterations insofar as they come within the scope of the appended claims or the equivalents thereof.

The invention claimed is:

1. A method of making a flexible grip for an implement handle comprising:

(a) formulating a first compound of one of (i) natural rubber, (ii) synthetic rubber, and (iii) blended rubber and inserting the first compound in a mold;

(b) molding and vulcanizing a tubular underlist with the first compound and removing the underlist from the mold;

(c) formulating a second compound of one of (i) natural rubber, (ii) synthetic rubber and (iii) blended rubber and forming the second compound into a sheet of desired thickness and pressure vulcanizing the sheet in a platen press at a pressure in the range of about 13,000 Kpa to about 24,000 Kpa and forming a textured surface thereon to form skin material;

(d) removing the skin material from the platen press and cutting a pattern from the skin material;

(e) printing colored designs with one of (i) rubber based thermally curable ink and (ii) rubber based thermally curable paint on the textured surface of the pattern and warm air curing the printed design;

(f) disposing unvulcanized rubber adhesive on one of (i) the surface of the pattern opposite the textured surface and (ii) the outer surface of the underlist and positioning the pattern over the tubular underlist to form an assembled grip; and, (g) inserting the assembled grip in a mold and compression vulcanizing at a temperature in the range of about 130° C.-185° C. and removing the vulcanized grip from the mold.

2. The method defined in claim 1, wherein the step of printing colored designs includes printing of multicolored rubber based thermally curable material.

3. The method defined in claim 1, wherein the step of printing includes printing colored designs with ethylene propylene diene monomer material.

4. The method defined in claim 1, wherein forming the second compound to a desired thickness includes forming to a thickness in the range of about 0.1 mm and 3.0 mm.

5. The method defined in claim 1, wherein the step of vulcanizing the second compound includes vulcanizing at a temperature in the range of about 130° C.-185° C.

6. The method defined in claim 1, wherein the step of disposing unvulcanized rubber adhesive includes disposing rubber solvent.

* * * * *